US011447976B2

(12) United States Patent
Pankratius

(10) Patent No.: US 11,447,976 B2
(45) Date of Patent: Sep. 20, 2022

(54) TWO-WHEELER LOCK HAVING AN ALARM FUNCTION

(71) Applicant: ABUS August Bremicker Söhne KG, Wetter-Volmarstein (DE)

(72) Inventor: Ernst Pankratius, Wetter (DE)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 635 days.

(21) Appl. No.: 16/458,865

(22) Filed: Jul. 1, 2019

(65) Prior Publication Data

US 2020/0011087 A1 Jan. 9, 2020

(30) Foreign Application Priority Data

Jul. 6, 2018 (DE) ..... 102018116434.3

(51) Int. Cl.
*E05B 45/00* (2006.01)
*E05B 45/06* (2006.01)
(Continued)

(52) U.S. Cl.
CPC ..... *E05B 45/005* (2013.01); *E05B 45/06* (2013.01); *E05B 47/0012* (2013.01); *E05B 67/063* (2013.01); *E05B 71/00* (2013.01)

(58) Field of Classification Search
CPC .... E05B 45/005; E05B 45/06; E05B 47/0012; E05B 67/063; E05B 71/00;
(Continued)

(56) References Cited

U.S. PATENT DOCUMENTS 4,290,279 A * 9/1981 Fish ..... E05B 67/24 70/52
4,358,943 A * 11/1982 Ouellet ..... E05B 77/283 70/358
(Continued)

FOREIGN PATENT DOCUMENTS

CN 2 209 200 Y 10/1995
CN 2505555 Y 8/2002
(Continued)

OTHER PUBLICATIONS

Chinese Office Action regarding Application No. 201910605004.5, dated May 28, 2021.
(Continued)

*Primary Examiner* — Lloyd A Gall
(74) *Attorney, Agent, or Firm* — Harness, Dickey & Pierce, P.L.C.

(57) ABSTRACT

A lock having an alarm function for a two-wheeler comprises a lock body and a securing hoop movable relative to the lock body between a securing position for securing the two-wheeler and an open position for releasing the two-wheeler. The lock body has a locking mechanism to selectively lock the securing hoop to the lock body in the securing position, and further comprises an alarm device for outputting an alarm signal. The locking mechanism can selectively be moved into an unlocked position, a locked position, or an alarm activation position, with the securing hoop being released for a movement into the open position in the unlocked position, with the securing hoop located in the securing position being locked at the lock body in the locked position, and with the alarm device being activated or being able to be activated by moving the locking mechanism into the alarm activation position.

10 Claims, 4 Drawing Sheets

(51) Int. Cl.
*E05B 47/00* (2006.01)
*E05B 67/06* (2006.01)
*E05B 71/00* (2006.01)

(58) Field of Classification Search
CPC ..... E05B 47/0001; E05B 67/24; E05B 2045/0665; E05B 2045/0635; Y10S 70/49; Y10T 70/459; Y10T 70/435; Y10T 70/483; Y10T 70/5872
See application file for complete search history.

(56) References Cited

U.S. PATENT DOCUMENTS

| | | | | |
|---|---|---|---|---|
| 5,398,529 | A * | 3/1995 | Goldman | E05B 67/22 70/53 |
| 5,408,212 | A | 4/1995 | Meyers et al. | |
| 5,417,092 | A * | 5/1995 | Iu | E05B 67/063 70/38 A |
| 5,561,996 | A * | 10/1996 | Chang | B60R 25/066 70/279.1 |
| 6,761,051 | B1 * | 7/2004 | Tsai | E05B 47/0012 70/279.1 |
| 7,665,333 | B2 * | 2/2010 | Shabtay | E05B 67/063 70/38 A |
| 7,823,424 | B2 * | 11/2010 | Shabtay | E05B 67/063 70/38 A |
| 7,921,682 | B1 | 4/2011 | Chang | |
| 8,225,629 | B2 * | 7/2012 | Zuraski | E05B 67/003 70/279.1 |
| 9,115,511 | B1 | 8/2015 | Schmidt et al. | |
| 2004/0045328 | A1 * | 3/2004 | Vito | B62H 5/00 70/38 A |
| 2004/0194516 | A1 * | 10/2004 | Chen | E05B 67/24 70/366 |
| 2009/0272160 | A1 * | 11/2009 | Chang | E05B 67/24 70/377 |
| 2011/0259063 | A1 | 10/2011 | Foti | |
| 2015/0137975 | A1 | 5/2015 | Maggi | |
| 2016/0333607 | A1 | 11/2016 | Gagan | |
| 2017/0254113 | A1 | 9/2017 | Pankratius et al. | |
| 2018/0258668 | A1 * | 9/2018 | Buseman | E05B 71/00 |

FOREIGN PATENT DOCUMENTS

| | | | |
|---|---|---|---|
| CN | 2 576 864 | Y | 10/2003 |
| CN | 201125582 | Y | 10/2008 |
| CN | 101545335 | A | 9/2009 |
| CN | 203961522 | U | 11/2014 |
| CN | 105113873 | A | 12/2015 |
| CN | 206091637 | U | 4/2017 |
| CN | 106 639 681 | A | 5/2017 |
| CN | 207513365 | U | 6/2018 |
| DE | 10 2005 043 927 | A1 | 3/2007 |
| DE | 10 2017 105 031 | A1 | 9/2018 |
| EP | 0 831 198 | A1 | 3/1998 |
| EP | 3 372 762 | A1 | 9/2018 |
| TW | 200951285 | A | 12/2009 |
| WO | WO-99/32348 | A1 | 7/1999 |

OTHER PUBLICATIONS

European Search report issued in European Patent Appication No. 19184447.1 dated Dec. 2, 2019; 3 pages.
Search Report from corresponding German Patent Application No. 10 2018 116 434.3, dated May 5, 2019, 8 pages, no translation provided.

* cited by examiner

TWO-WHEELER LOCK HAVING AN ALARM FUNCTION

CROSS-REFERENCE TO RELATED APPLICATIONS

This application claims the benefit and priority of German application number 102018116434.3 filed Jul. 6, 2018. The entire disclosure of the above application is incorporated herein by reference.

FIELD

The present invention relates to a lock having an alarm function for a two-wheeler, having a lock body, and having a securing hoop that is movable relative to the lock body between a securing position for securing the two-wheeler and an open position for releasing the two-wheeler, wherein the lock body has a locking mechanism to selectively lock the securing hoop to the lock body in the securing position, and wherein the lock body further comprises an alarm device for outputting an alarm signal.

BACKGROUND

Such a lock can, for example, be configured as a U hoop lock that has a rigid, substantially U-shaped securing hoop or as a folding lock having a jointed bar as the securing hoop that has a plurality of jointed bars pivotably connected to one another. A two-wheeler lock of the said kind can also be configured as a so-called frame lock in which a rotatable hoop or a pivot hoop engages between the spokes of one of the wheels of a bicycle. Such a lock can furthermore be configured as a brake disk lock, for example, in which the securing hoop engages into a ventilation opening of a brake disk of a motorcycle or of a motor scooter. The securing hoop can also be flexible, for example in the form of a chain or of a steel cable that can be selectively locked at the lock body.

A lock of the said kind serves, for example, to secure a two-wheeler to a bicycle stand, to a lamppost, or to another stationary object or to secure a two-wheeler against unauthorized riding away. When the securing hoop is unlocked, the securing hoop can be moved into an open position in which the securing hoop is released from the lock body at one end or completely. Starting from the open position, the securing hoop can, for example, be led around a frame section of the two-wheeler and a bicycle stand, lamppost, or the like or the securing hoop is only led through a moving part (e.g. rim, brake disk) of the two-wheeler. The securing hoop can then be (completely) closed and locked at the lock body to thus secure the two-wheeler against unauthorized removal or an unauthorized riding away. The unlocking of the securing hoop can take place in that the authorized user actuates the locking mechanism of the lock by means of an associated key or another identification means.

The time required for the unauthorized opening of the lock is an important aspect in the event of a manipulation attempt at a lock of the named kind to steal a two-wheeler thereby secured. The less time available to a thief, the more difficult a successful manipulation attempt becomes. It is therefore conceivable to equip the lock with an alarm device that outputs an acoustic and/or optical alarm signal as soon as a manipulation attempt is detected, for example by determination of a positional change or of a vibration during a monitoring operation. In practice, however, a comfortable operation of such an alarm device by the authorized user is difficult, in particular as regards the arming of the alarm device (called the "activation" of the alarm device in the following). An alarm device that is, for example, sensitive to vibration may not trigger the output of an alarm signal during the transport of the lock and an activation of the alarm device is also not desired on every locking up of the two-wheeler (e.g. securing the two-wheeler to a bike rack of a motor vehicle).

SUMMARY

It is therefore an object of the invention to provide a two-wheeler lock having an alarm function that enables a comfortable and reliable operation of the alarm device.

This object is satisfied by a two-wheeler lock having an alarm function and a locking mechanism that can be selectively moved into an unlocked position, a locked position, or an alarm activation position, wherein the securing hoop is released for a movement into the open position in the unlocked position, wherein the securing hoop located in the secured position is locked at the lock body in the locked position, and wherein the alarm device is or can be activated by setting the locking mechanism into the alarm activation position.

The locking mechanism can also be moved—at least temporarily—into an alarm activation position in addition to its unlocked position and its locked position. The alarm device of the two-wheeler lock can be activated as long as the locking mechanism is in the alarm activation position. Provision can also be made that the alarm device is activated by a temporary movement of the locking mechanism into the alarm activation position, with the alarm device being able to remain activated even if the locking mechanism is automatically moved into a different position. The alarm activation position can form a further (i.e. second) locking position with respect to the locking mechanism as will be explained in the following.

The fact can at least be utilized that an actuation of the locking mechanism of the two-wheeler lock by the authorized user is anyway provided, in particular for an unlocking or locking, for example by means of an associated key, by means of an electronic identification means, by transmission of a code, or by a combination thereof. The authorized user cannot only select the locked state or unlocked state of the locking mechanism by a suitable actuation of the locking mechanism, namely by the moving of the locking mechanism into an alarm activation state, but can also determine whether the alarm device should become or be activated or not. The alarm activation position can in this respect be determined indirectly (for example, from a control signal for the locking mechanism) or directly (for example by a position detector). A comfortable and in particular also failsafe operation of the two-wheeler lock and in particular of the alarm device hereby results.

Advantageous embodiments of the invention can be seen from the dependent claims, from the description and from the drawing.

In some embodiments, the two-wheeler lock can be configured such that the alarm device is automatically activated by moving the locking mechanism into the alarm activation position.

In some embodiments, the locking mechanism is designed as purely mechanical.

The locking mechanism can in particular have a lock cylinder that is rotationally actuable by means of a key. The lock cylinder can be directly or indirectly coupled to one or more latches to release the securing hoop in the unlocked position and to lock the securing hoop (provided it is in the securing position) at the lock body in the locked position. In some embodiments, the alarm device can be directly or indirectly activated by a rotational actuation of the lock cylinder by means of the key in that the lock cylinder is moved into an alarm activation position that differs from the unlocked position and the locked position or from a first locked position.

In some embodiments, the lock cylinder can have a cylinder housing and a cylinder core rotatably supported in the cylinder housing, wherein the locked position of the locking mechanism corresponds to a first rotational position of the cylinder core, wherein the alarm activation position of the locking mechanism corresponds to a second rotational position of the cylinder core, and wherein the unlocked position of the locking mechanism corresponds to a third rotational position of the cylinder core. The user can hereby easily distinguish the different positions or states of the locking mechanism from one another and can select them without operating error.

Provision can be made in some embodiments that the lock cylinder can be actuated, starting from the unlocked position, into a first direction of rotation or into a second direction of rotation opposite thereto. The unlocked position thus forms a center position for the actuation of the lock cylinder to selectively move the locking mechanism or the lock cylinder into a different position. Provision can be made in other embodiments that the lock cylinder can be actuated, starting from the locked position, into a first direction of rotation or into a second direction of rotation opposite thereto. The locking position thus forms a center position for the actuation of the lock cylinder.

In some embodiments, the first rotational position, the second rotational position, and the third rotational position of the cylinder core can be offset by 90° with respect to one another in each case. A clear, easily visible distinguishing of the different rotational positions hereby results for the user to be able to operate the locking mechanism without error. The first rotational position of the cylinder core can, for example, be offset by an angle of 90° with respect to the third rotational position of the cylinder core, with the second rotational position of the cylinder core being offset by an angle of 90° with respect to the third rotational position of the cylinder core and by an angle of 180° with respect to the first rotational position of the cylinder core.

In some embodiments, the key can be introducible into the cylinder core and can be removable from the cylinder core in two different positions of the cylinder core. Two different positions of the locking mechanism can hereby be selected in which the associated key can be removed from the lock cylinder. These two different positions can in particular be two locked positions to respectively lock the securing hoop at the lock body (with an activated alarm device or a deactivated alarm device). Provision can, for example, be made that the associated key can be introducible into the cylinder core and can be removable from the cylinder core both in the first rotational position of the cylinder core and in the second rotational position of the cylinder core.

In some embodiments, the lock cylinder can have a plurality of tumblers that are moved into the cylinder core by introducing the key into the cylinder core. A specific secret code of the respective lock cylinder can be encoded by the plurality of tumblers.

The lock cylinder can in particular be configured as a disk tumbler cylinder having a plurality of disk tumblers such as is generally known, for example, from DE 102014108355 A1. A disk tumbler cylinder makes a configuration possible in which the associated key can be removed from the cylinder core in two different rotational positions, in particular displaced by 180° with respect to one another.

As regards the mechanical locking of the securing hoop to the lock body, in some embodiments the locking mechanism can have one or more latches that lock the securing hoop, provided it is in the securing position, at the lock body. The locking mechanism can in particular have at least one latch that can be driven by means of the associated key (in particular via a lock cylinder) and that is in engagement with the securing hoop in the locked position of the locking mechanism to lock the securing hoop to the lock body.

In some embodiments, the latch or a further latch that can be driven by means of the lock cylinder can be in engagement with the securing hoop in the alarm activation position of the locking mechanism. The alarm activation position can in this respect form a further locked position of the locking mechanism.

In some embodiments, the securing hoop can have at least one locking recess, with a latch engaging into the locking recess when the locking mechanism is in the locked position (or in a further locked position). In the unlocked position of the locking mechanism, the respective latch in contrast does not engage into the associated locking recess(es) of the securing hoop. The respective locking recess can, for example, be formed as a groove or as a bore.

In some embodiments, the lock cylinder can be coupled to the at least one latch via a deflection device that deflects a rotational movement of the lock cylinder into a linear movement of the latch. The deflection device can have at least one eccentric prolongation (e.g. a pin), another kind of cam, or a ramp, with an associated counter-element (e.g. a guide path, slotted part, or counter-ramp) being able to be provided. One element of the deflection device can be associated with the lock cylinder and one further element of the deflection device can be associated with the respective latch. The linear movement of the latch can be a lateral, in particular a radial, movement with respect to the axis of rotation of the lock cylinder or can be an axial movement, in particular offset coaxially or in parallel with the axis of rotation of the lock cylinder.

In other embodiments, however, a rotational movement or a pivot movement of the respective latch can also be provided, with the lock cylinder being able to be coupled to the at least one latch directly or indirectly, in particular via a deflection device.

Alternatively to a purely mechanical embodiment, the locking mechanism can be designed as electromechanical in some embodiments.

The locking mechanism can in particular have an electric motor that serves as an actuating motor, in particular to drive at least one latch of the locking mechanism. Such an electric motor can be directly or indirectly coupled to one or more latches to release the securing hoop in the unlocked position and to lock the securing hoop (provided it is in the securing position) at the lock body in the locked position. In some embodiments, the alarm device can be directly or indirectly activated by a rotational movement of the electric motor in that the electric motor or a drive element arranged downstream is moved into an alarm activation position that differs from the unlocked position and the locked position or from a first locked position.

The locking mechanism can therefore also have at least one latch in an electromechanical embodiment, said latch being electrically drivable to make a locking movement and/or an unlocking movement and being in engagement with the securing hoop in the locked position of the locking mechanism to lock the securing hoop at the lock body.

The actuation of an electromechanical locking mechanism by the authorized user can take place, for example, by an electronic identification means (e.g. a transponder), by transmission of a code (e.g. by radio, in particular via a mobile end device), by actuating a switch provided at the two-wheeler lock, or by a combination thereof.

Alternatively to an electric motor, an electromechanical locking mechanism can, for example, have an electromagnetic drive device.

In some embodiments, the alarm activation position of the locking mechanism can, as already mentioned, form a further locking position, i.e. the securing hoop, provided it is in the securing position, can be locked at the lock body both in the locked position and in the alarm activation position. In these embodiments, the alarm device can be deactivated in the one locked position, with the alarm device being activated in the other locked position. The user can thus select one of two different locked positions, in addition to the unlocked position, in which the alarm device can be deactivated, in which the securing hoop is admittedly likewise mechanically locked (in particular purely mechanically or electromechanically), but the alarm device is either activated or deactivated.

Such an embodiment is in particular suitable for a two-wheeler lock having a so-called forced locking in which the locking mechanism necessarily has to be moved into a locked position to be able to remove an associated key. By actuating the locking mechanism by means of the associated key for the purpose of locking the securing hoop, the user can thus not only bring about a desired mechanical locking, but can also simultaneously and in a simple manner select whether the alarm device should be activated or not.

In some embodiments, the securing hoop can have at least one first locking recess and at least one second locking recess, wherein the securing hoop is locked at the first locking recess in the locked position of the locking mechanism and wherein the securing hoop is locked at the second locking recess in the further locking position of the locking mechanism. It is hereby possible that the locking mechanism can adopt different locked positions (for example different rotational positions of a lock cylinder, of an electric motor, or of a drive element arranged downstream) in which a locking of the securing hoop takes place, wherein different states of the alarm device can be set or can be selected by the different locked positions.

In some embodiments, the locking mechanism can have two latches, wherein one of the two latches engages into the first locking recess of the securing hoop in the locked position of the locking mechanism and wherein the other one of the two latches engages into the second locking recess of the securing hoop in the further locked position of the locking mechanism, Provision can in particular be made in such embodiments having two latches that on an actuation of the locking mechanism in a first direction of rotation, the two latches are driven in opposite senses to one another, with the two latches also being driven in opposite senses to one another on an actuation of the locking mechanism in a direction of rotation opposite to the first direction of rotation. A similar movement (namely in opposite senses to one another) of the latches is thus provided despite a different direction of actuation of the locking mechanism, with a desired state of the alarm device being able to be selected by the direction of actuation.

Provision can in particular be made in some embodiments that the securing hoop has a first hoop end and a second hoop end of which each has a first locking recess and a second locking recess, wherein the one of the two latches engages into the first locking recess of the first hoop end and the other one of the two latches engages into the first locking recess of the second hoop end in the locked position of the locking mechanism, and wherein the one of the two latches engages into the second locking recess of the second hoop end and the other one of the two latches engages into the second locking recess of the first hoop end in the further locked position of the locking mechanism.

It is, however, not absolutely necessary that the locking mechanism has two latches. In some embodiments, the locking mechanism can only have a single latch that, starting from the unlocked position of the locking mechanism, is moved in the same direction independently of the direction of a locking actuation of the locking mechanism (in particular independently of the direction of a rotational actuation of a lock cylinder or of an electric motor). Provision can in particular be made that, starting from the unlocked position of the locking mechanism, an actuation can take place in two different directions to move the locking mechanism into a respective locked position, for example a rotational actuation in two different directions of rotation by means of the associated key. In this respect, the two different actuation directions can effect the same locking direction of movement of the latch. Provision can be made for this purpose that the locking mechanism has a deflection device (in particular the already named deflection device) having mutually symmetrical drive sections that drive the latch in the same direction independently of an actuation direction of the locking mechanism. Such a deflection device can, for example, have mutually symmetrical ramps by which the latch is driven. Nevertheless, two different actuation directions of the locking mechanism can differ from one another with respect to a control of the alarm device, for example in that a corresponding position detector (for example a sensor or a switch) is only addressed in one of two possible actuation directions (for example via a permanent magnet or an elevated portion).

In some embodiments, the alarm device can be alternatingly be able to be activated and deactivated by a multiple movement of the locking mechanism into the alarm activation position. A desired state of the alarm device can hereby be selected by a temporary movement of the locking mechanism into the alarm activation position without the locking mechanism having to remain in the alarm activation position. A switchover between an activated state of the alarm device and a deactivated state of the alarm device can in particular be effected by a respective moving of the locking mechanism into the alarm activation position. It is hereby possible, for example, that two positions of the locking mechanism (locked position and unlocked position) are exclusively provided or the mechanical locking function and that a further position (alarm activation position) is exclusively provided for the activation of the alarm device.

Such an embodiment is in particular suitable for a two-wheeler lock having a so-called automatic function in which—unlike with said forced locking—an automatic locking of the securing hoop at the lock body takes place in that the securing hoop is moved from the open position into the securing position, with the locking mechanism briefly moving out of the locked position into the unlocked position and automatically moving back into the locked position. This automatic resetting into the locked position can in particular take place on the basis of a spring preload of the locking mechanism. For example, at least one spring-loaded latch can be briefly urged back by the securing hoop, while the securing hoop is introduced into the lock body and the respective latch can then latchingly engage at the securing hoop.

With such a two-wheeler lock having an automatic function, the alarm activation position of the locking mechanism can be set by actuating the locking mechanism, for example by means of an associated key, with this being able to take place against a spring preload (in particular against a spring preload that is provided in addition to the spring preload for the automatic function). The authorized user can thus also select the desired state of the alarm device (activated or deactivated) by means of a key that he anyway requires for an unlocking of the locking mechanism. Alternatively to this, different kinds of actuation of an electromechanical locking mechanism can be provided to selectively activate the alarm device.

Independently of the embodiment of the locking mechanism, the two-wheeler lock can have a position detector that is configured to determine whether the locking mechanism is in the alarm activation position. The position detector can thus serve to determine whether, in accordance with the set state of the locking mechanism, a specific state of the alarm device is to be set. The position detector can have a suitable sensor system for this purpose. The position detector can be configured to generate a positive determination signal if the position detector determines that the locking mechanism is located in the alarm activation position. The position detector can be part of an evaluation and control circuit of the alarm device in some embodiments. The position detector can contribute to or be configured for the activation of the alarm device if it is determined that the locking mechanism is in the alarm activation position. It can be sufficient for this purpose in some embodiments if the position detector determines that the locking mechanism was only briefly in the alarm activation position.

In some embodiments, the position detector can have a magnetic field sensor, a magnetic switch (e.g. a reed switch), or a contact switch. The magnetic field sensor or the magnetic switch can in particular cooperate with a permanent magnet that is connected to an element of the locking mechanism (e.g. a latch, a lock cylinder, an electric motor, a drive element, or a deflection device) and that moves relative to the magnetic field sensor or the magnetic switch on an actuation of the locking mechanism. Depending on the relative position between the magnetic field sensor or the magnetic switch, on the one hand, and the permanent magnet, on the other hand, a determination can be made whether the locking mechanism is in the alarm activation position. The contact switch can in particular cooperate with an elevated portion that is formed at an element of the locking mechanism (e.g. a latch, a lock cylinder, an electric motor, a drive element, or a deflection device) and that moves relative to the contact switch on an actuation of the locking mechanism.

The alarm device of the two-wheeler lock can be configured to output an acoustic and/or optical alarm signal as soon as a manipulation attempt is detected at the lock, for example by determining a positional change or a vibration of the lock while the alarm device is activated and is in monitoring operation.

In some embodiments, the alarm device can have at least one (in particular a plurality or all) of the following components:

- an electrical energy source for the energy supply of further components of the alarm device;
- an acceleration sensor or a vibration sensor;
- an evaluation and control circuit;
- said position detector;
- an acoustic and/or optical signal generator; and/or
- a radio transmission unit for the wireless transmission of an alarm signal.

The energy source here can comprise one or more commercial batteries and/or an electrical rechargeable battery.

As regards the acceleration sensor, it can be configured as a static acceleration sensor and/or as a dynamic acceleration sensor, wherein the static acceleration sensor can be configured as an inclinometer for recognizing an alignment and/or positional change (detection of gravity), and the dynamic acceleration sensor can be used for recognizing a time-dependent acceleration (e.g. on the basis of a blow applied to the lock). The acceleration sensor or an associated evaluation and control circuit can in particular compare one or more detected acceleration values with a respective threshold value. The acceleration sensor can hereby also be configured as a vibration sensor. However, a different kind of vibration sensor can also be provided that can in particular directly detect a predetermined vibration.

In some embodiments, the evaluation and control circuit can be configured to evaluate the signal of said position detector. The evaluation and control circuit can furthermore be configured also to evaluate the signal of said acceleration sensor or vibration sensor to in particular trigger the output of an alarm signal on a detection of a positional change or a vibration during monitoring operation (for example on the basis of a comparison with a threshold value). In some embodiments, the evaluation and control circuit can be configured to first trigger the output of a pre-alarm signal on a detection of a positional change or vibration and only to trigger the output of a main alarm signal after an elapse of a main alarm delay interval and a continuing detection of the positional change or vibration. The evaluation and control circuit can furthermore be configured to take account of a movement detection delay interval such as is known, for example, for a brake disk lock of DE 102005043927 A1.

The acoustic and/or optical signal generator can, for example, comprise a loudspeaker, in particular a piezo loudspeaker and/or a light emitting diode.

Alternatively or additionally to the output of an acoustic or optical alarm signal, the two-wheeler lock can have a radio transmission unit for a wireless transmission of an alarm signal, in particular to a radio reception unit of the authorized user. Such a radio reception unit can be a separate device associated with the two-wheeler lock (for example the already named radio control unit) or a cell phone. The signal transmission can take place in accordance with a common standard (e.g. Bluetooth, wireless LAN, GSM).

In some embodiments, in particular also in those having forced locking or an automatic function of the locking mechanism, provision can be made that the alarm device outputs an acoustic and/or optical confirmation signal when a specific state of the alarm device is set. Provision can in particular be made that different confirmation signals (for example different sound sequences or pitches or different colors of a light signal) are output depending on whether the alarm device has been activated or deactivated. The output of such confirmation signals can in particular be triggered by said evaluation and control circuit.

As regards the design and functionality of the securing hoop, in some embodiments the securing hoop can be completely releasable from the lock body in the open position (for example with a so-called U hoop). In other embodiments, the securing hoop can be permanently fastened, but movably supported, at the lock body. For example, the securing hoop can be permanently fastened to the lock body at one end (in particular rigidly or rotatably or pivotably), with a different free end of the securing hoop being able to be selectively locked at the lock body.

In some embodiments, the securing hoop can be U-shaped and have two hoop ends, with the lock body having two introduction openings for receiving the hoop ends.

In some embodiments, the securing hoop can be rigid. In other embodiments, the securing hoop can be flexible (in particular in the form of a steel cable or of a chain). In some embodiments, the securing hoop can be configured as a jointed bar that has a plurality of jointed bars pivotably connected to one another.

In some embodiments, the two-wheeler lock can be configured as a U hoop lock (such as known from DE 100 26 701 A1 or DE 10 2007 035 122 A1), as a folding lock having a jointed bar (such as known from DE 102005040066 A1), as a brake disk lock (such as known from DE 102005043927 A1), or as a frame lock. Such a frame lock can in particular have a rotatable hoop (such as known from (DE 10252080 A1), as a pivot hoop (such as known from DE 102011015313 A1), or as a linearly movable hoop (such as known from DE 102012002903 A1).

The two-wheeler lock can be a portable lock or can be fixedly mounted at the two-wheeler.

FIGURES

The invention will be explained only by way of example in the following with reference to the Figures.

DESCRIPTION

Figure 1:
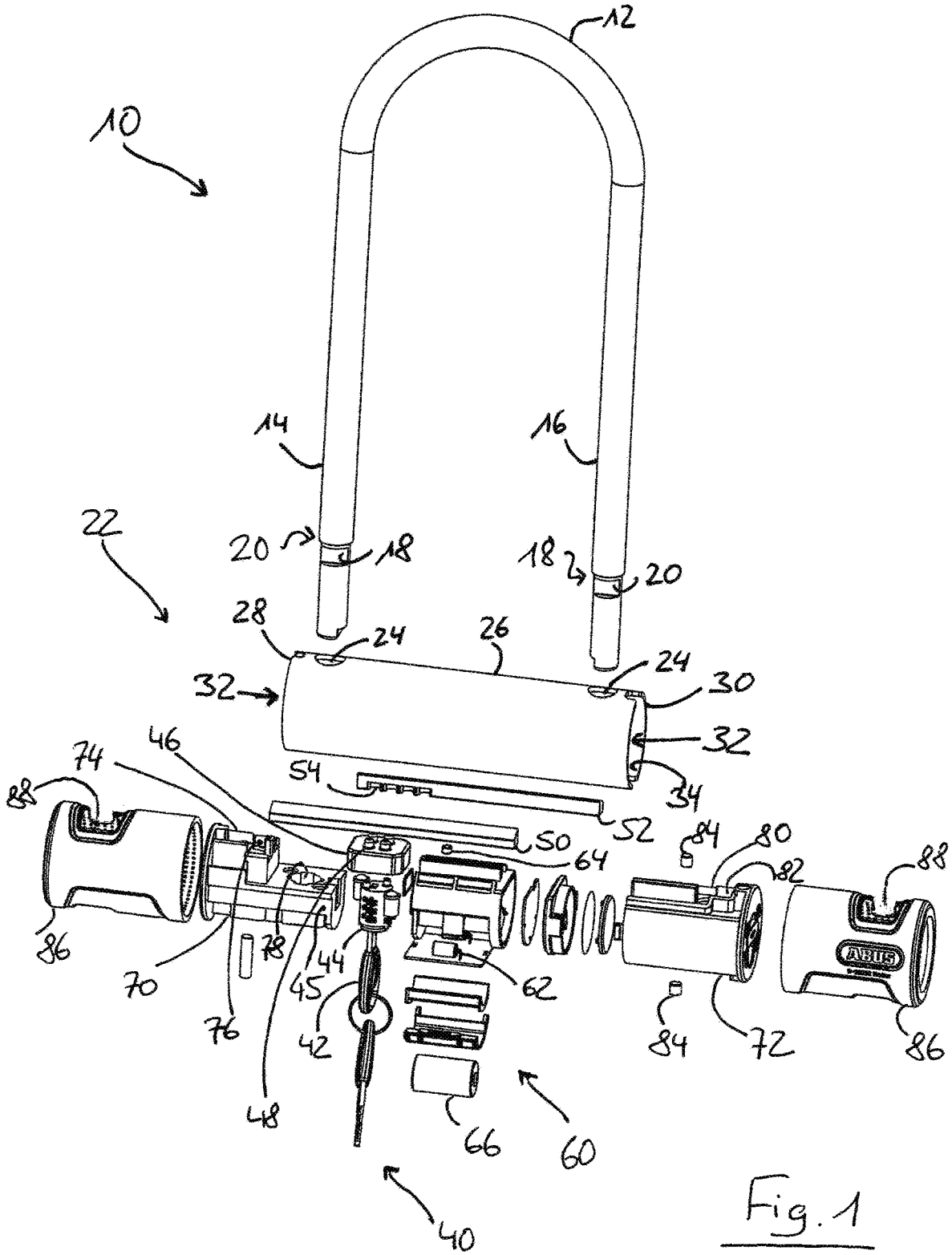
FIG. 1 shows an exploded representation of an embodiment of the two-wheeler lock in accordance with the invention.

FIG. 1 shows an exploded view of an embodiment of a two-wheeler lock 10 in accordance with the invention having an alarm function. The two-wheeler lock 10 comprises a lock body 22 and a securing hoop 12 that can in particular be produced from metal. The securing hoop 12 of this embodiment is rigid and of U shape and has a first end 14 and a second end 16 that can be introduced into the lock body 22. At its first end 14, the securing hoop 12 has a first locking recess 18 at the front side shown in FIG. 1 and a second locking recess 20 at the rear side (not visible in FIG. 1). At its second end 16, the securing hoop 12 has a second locking recess 20 at its front side and a first locking recess 18 at its rear side. The first and second locking recesses 18, 20 can each cooperate with a locking mechanism 40 to lock the securing hoop 12 at the lock body 22.

The lock body 22 comprises a tubular housing 26 that can in particular be formed from metal. The housing 26 has a first end 28 and a second end 30 at its longitudinal side. A respective access opening 32 is formed at the ends 28, 30 and an inner space 34 of the housing 26 is accessible via it. In an alternative embodiment, one of the access openings 32 can also be closed; in this case the housing 26 forms a cylinder open at one side. At the peripheral side, the housing 26 has introduction openings 24 close to its respective ends 28, 30. The ends 14, 16 of the securing hoop 12 can be led through the introduction openings into the inner space 34 of the housing 26 to close the two-wheeler lock 10 and to lock the securing hoop 12 at the lock body 22.

The inner space 34 of the housing 26 accommodates the locking mechanism 40 and an alarm device 60. The locking mechanism 40 comprises a lock cylinder that can be rotationally actuated by an associated key 42 and that has a cylinder core 44; it furthermore comprises a drive prolongation 46, a first latch 50, and a second latch 52. The cylinder core 44 is rotatably supported in a cylinder housing 45. The lock cylinder can, for example, be configured as a disk tumbler cylinder having a plurality of disk tumblers, which makes a configuration possible in which the key 42 can be removed from the cylinder core 44 in two different rotational positions in particular offset from one another by 180°.

The lock cylinder is coupled to the first latch 50 and to the second latch 52 via the drive prolongation 46 to drive the latches 50, 52 to make an unlocking movement or a locking movement. The securing hoop 12 can hereby be released for a movement into an open position in an unlocked position of the locking mechanism 40 and the securing hoop 12 located in the closed position can be locked at the lock body 22 in a locked position. The drive prolongation 46 is arranged between the cylinder core 44 of the lock cylinder and the latches 50, 52 and acts as a deflection device that deflects a rotational movement of the cylinder core 44 into a linear movement of the latches 50, 52. In the specific embodiment, the drive prolongation 46 has a plurality of eccentrically arranged pins 48 that can engage into corresponding guide paths 54 of the first and second latches 50, 52 to move them laterally on a rotational movement of the cylinder core 44.

The alarm device 60 comprises an acceleration sensor, not shown, or a vibration sensor and a position detector 62 for determining the position of the locking mechanism 40. The position detector 62 can, for example, have a magnetic field sensor, a magnetic switch (e.g. a reed switch), or a contact switch. In the specific embodiment, the position detector 62 in particular determines a position of a permanent magnet 64 arranged at the first latch 50. It moves on an actuation of the locking mechanism 40 and on a corresponding movement of the first latch 50 relative to a magnetic field sensor or to a magnetic switch of the position detector 62, whereby a change of the magnetic field strength is effected at the magnetic field sensor or at the magnetic switch. The measured value of the magnetic field strength is used to determine the position of the permanent magnet 64 and thus the position of the first latch 50 relative to the position detector 62. In other embodiments, further permanent magnets can be provided that can, for example, be connected to the second latch 52 to also detect the position of the second latch 52. However, embodiments are also conceivable that dispense with permanent magnets 64 to determine the position of the first latch 50 and/or of the second latch 52 by means of the position detector 62, for example by using a contact switch. Such a contact switch can, for example, cooperate with an elevated portion at one of the latches 50, 52 or with a cam of the drive prolongation 46.

The alarm device 60 further comprises an energy source 66, e.g. one or more commercial batteries and/or electrically rechargeable batteries, an evaluation and control circuit, an acoustic and/or optical signal generator, e.g. a loudspeaker and/or a light emitting diode, and/or a radio transmission unit for the wireless transmission of an alarm signal (not shown).

The first end 28 and the second end 30 of the housing 26 are each closed by a first closure 70 and by a second closure 72. The first closure 70 is a substantially semicylindrical carrier body. The carrier body is introduced with shape matching along a cylindrical periphery into the access opening 32 of the housing 26 formed at the first end 28 of the housing 26. The first closure 70 has a first securing section 74 having an introduction opening 76 that is aligned with one of the introduction openings 24 of the housing 26 in an assembled state of the first closure 70 in which the first closure 70 closes the first end 28 of the housing 26. Laterally offset from the first securing section 74, the first closure 70 comprises the cylinder housing 45 that forms a receiver 78 in the carrier body in which the cylinder core 44 is supported.

The alarm device 60 is substantially arranged in the second closure 72 of the housing 26. The second closure 72 is introduced with shape matching into the access opening 32 of the housing 26 formed at the second end 30 of the housing 26. The second closure 72 is formed as a substantially cylindrical body that releasably closes the second end 30 of the housing 26 in an assembled state. Along its periphery, the second closure 72 has a second securing section 80 having an introduction opening 82 that aligns with one of the introduction openings 24 of the housing 26 in the assembled state of the second closure 72. The second closure 72 is secured in a force fitting manner against an accidental release from the housing 26 in the assembled state by at least one permanent magnet 84 (two in the case shown), said permanent magnets being arranged at an outer side of the second closure 72 and being able to enter into a magnetic connection with the material of the housing 26.

The first end 28 and the second end 30 of the housing 26 are surrounded by a respective protective envelope 86 at the outer side. The protective envelopes 86 have introduction openings 88 that align with the introduction openings 24 of the housing 26. The protective envelopes 86 can be formed as a cap and can, for example, be produced from a flexible material, in particular plastic. To enable access to the inner space 34 of the housing 26, the protective envelopes 86 are releasable, i.e. they can be removed from the housing 26 or pulled onto the housing 26 by a light pulling or pushing.

Figure 2:
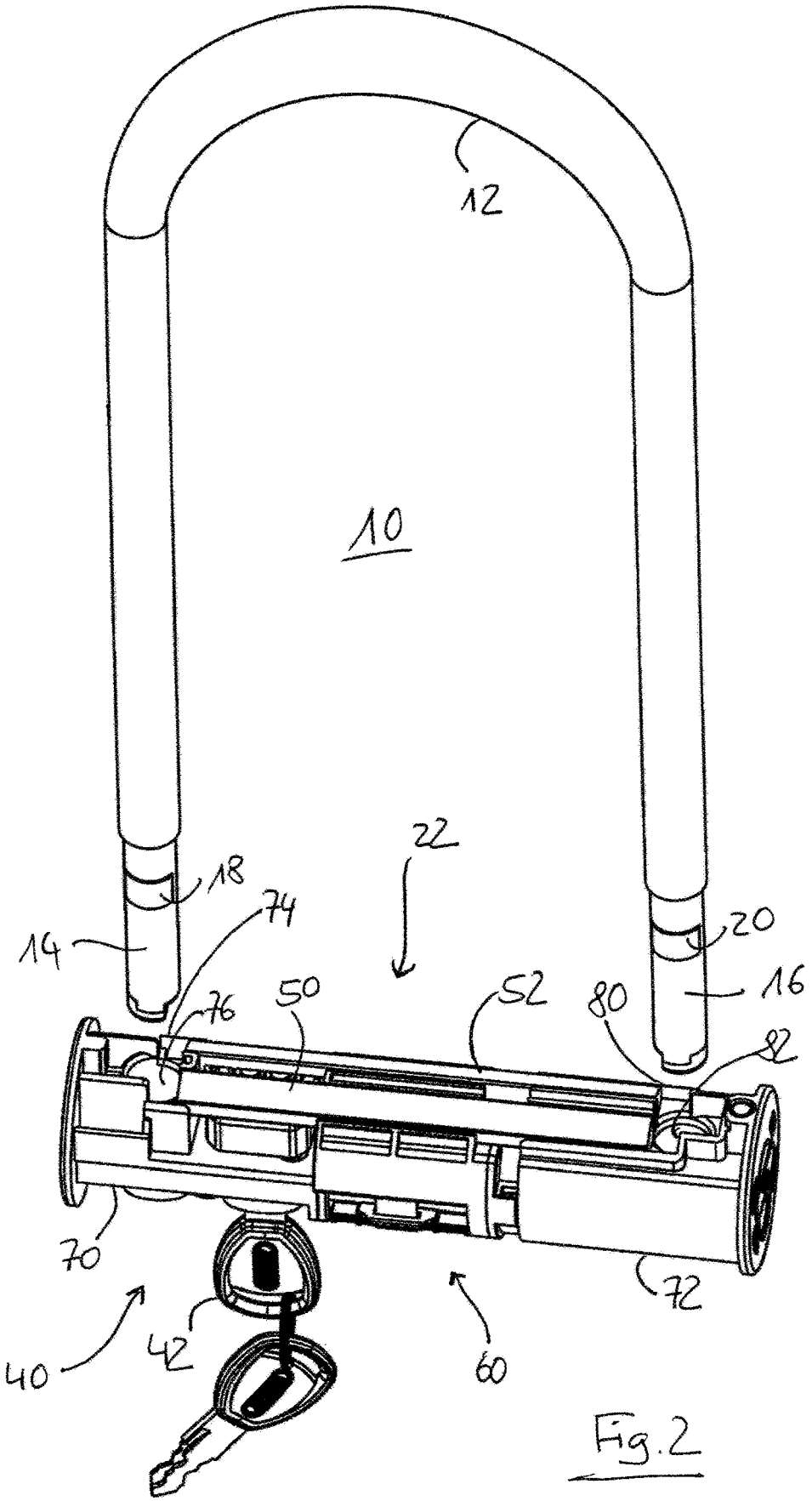
FIG. 2 shows a perspective view of the embodiment of FIG. 1, with the locking mechanism being in an unlocked position.

FIG. 2 shows a perspective view of the embodiment of FIG. 1, with the locking mechanism 40 being in an unlocked position. In the view shown, the housing 26 and the protective envelope 86 have been removed to illustrate the locking mechanism 40. In the unlocked position, neither the first latch 50 nor the second latch 52 of the locking mechanism 40 is in engagement with the first and second locking recesses 18, 20 of the securing hoop 12. The securing hoop 12 is thus released for a movement into the shown open position in which its two ends 14, 16 are completely released from the lock body 22. The alarm device 60 is not activated in the unlocked position of the locking mechanism 40.

Starting from the unlocked position, the cylinder core 44 can be rotationally actuated by means of the key 42 selectively into a first direction of rotation or into a second direction of rotation opposite thereto. The unlocked position thus forms a center position for the actuation of the lock cylinder to selectively move the locking mechanism 40 or the lock cylinder into a different position. The lock cylinder or the lock core 44 can be moved into a first rotational position, corresponding to a first locked position, by a rotational actuation in the first direction of rotation (cf. FIG. 3). The lock cylinder or the core cylinder 44 can equally be moved into a second rotational position, corresponding to a second locked position, by a rotational actuation in the second direction of rotation (cf. FIG. 4).

In this respect, the first rotational position, the second rotational position, and the third rotational position (corresponding to the center position of the cylinder core 44) can each be offset from one another by 90°. In other words, the first rotational position of the cylinder core 44 can be offset by an angle of 90° with respect to the third rotational position, with the second rotational position of the cylinder core 44 being able to be offset by an angle of 90° with respect to the third rotational position and by an angle of 180° with respect to the first rotational position. A clear, easily visible distinguishing of the different rotational positions hereby results for a user to be able to operate the locking mechanism 40 without error. However, different angles of rotation and different orders of the rotational positions are also possible.

On an actuation of the locking mechanism 40 by a rotational actuation of the key 42, the first latch 50 and the second latch 52 are driven, in respective opposite senses to one another, both in the first direction of rotation and in the second direction of rotation. Despite a different direction of actuation of the locking mechanism 40, a similar movement, in opposite senses to one another, of the first and second latches 50, 52 is thus provided, with the user being able to select a desired locked position by the direction of actuation. In this respect, the movement in opposite senses of the first and second latches 50, 52 is effected by the drive prolongation 46 of the lock cylinder whose pins 48 engage into the guide paths 54 of the first and second latches 50, 52 to move them laterally in opposite senses on a rotational actuation of the lock cylinder 44.

Figure 3:
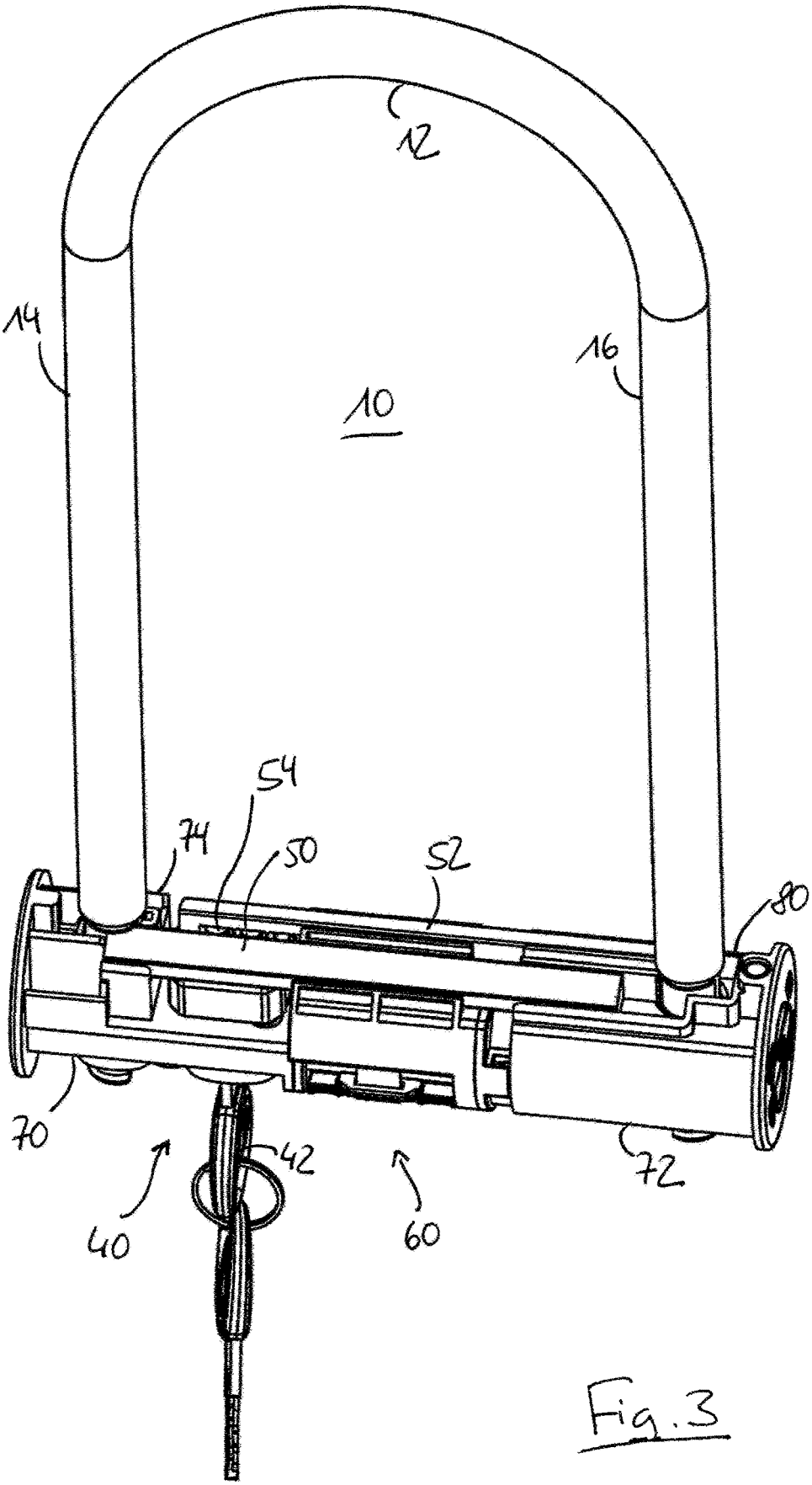
FIG. 3 shows a perspective view of the embodiment of FIG. 1, with the locking mechanism being in a first locked position.

FIG. 3 shows a perspective view of the embodiment of FIG. 2, with the locking mechanism 40 being in the first locked position. The securing hoop 12 adopts the closed position, with its first end 14 engaging into the introduction opening 76 of the first closure 70 and its second end 16 engaging into the introduction opening 82 of the second closure 72. In the first locked position, the first latch 50 is in engagement with the first locking recess 18 of the first end 14 of the securing hoop 12, while the second latch 52 is in engagement with the (rear) first locking recess 18 of the second end 16 of the securing hoop 12. The securing hoop is thus mechanically secured in the lock body 22 in the first locked position. The alarm device 60 is also not activated in the first locked position of the locking mechanism 40.

Figure 4:
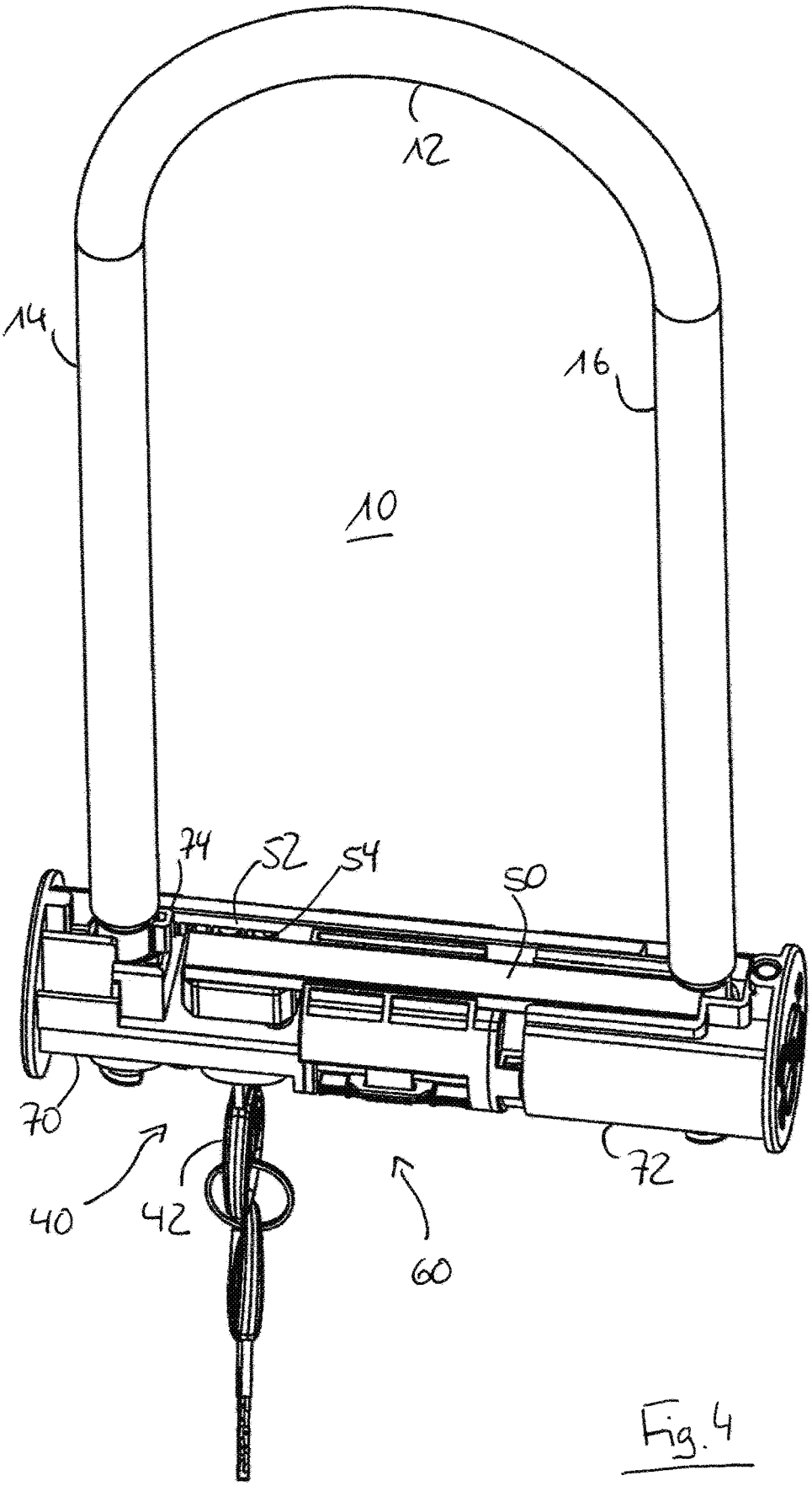
FIG. 4 shows a perspective view of the embodiment of FIG. 1, with the locking mechanism being in an alarm activation position that simultaneously forms a second locked position.

FIG. 4 shows a perspective view of the embodiment of FIG. 2, with the locking mechanism 40, however, being in the second locked position that simultaneously corresponds to an alarm activation position of the locking mechanism 40. The key 42 is rotated by 180° with respect to the rotational position in accordance with FIG. 3. In the second locked position, the first latch 50 is in engagement with the second locking recess 20 of the second end 16 of the securing hoop 12, while the second latch 52 is in engagement with the (rear) second locking recess 20 of the first end 14 of the securing hoop 12. If the locking mechanism 40 is in the second locked position, a detection signal corresponding to the position of the first latch 50 is generated in the position detector 62, said detection signal being able, for example, to be forwarded to the evaluation and control circuit of the alarm device 60 to activate the alarm device 60. This activation of the alarm device 60 can take place directly or with a time delay, for example to enable the ending of a locking process for the authorized user. The securing hoop 14 is thus mechanically secured to the lock body 22 in the second locked position of the locking mechanism 40 and is additionally protected from possible manipulations by the activated alarm device 60.

By activating the alarm device 60, the alarm device 60 can be changed into a monitoring operation in which the alarm device 60 constantly checks whether an impermissible positional change or another movement has taken place on the basis of the signals of the acceleration sensor or vibration sensor and, for example, of a comparison with a respective threshold value. In the positive case, the alarm device 60 outputs an acoustic and/or optical alarm signal. Provision can be made in this respect that first a pre-alarm signal is output, with a main alarm signal only being output after the elapse of a main alarm delay interval and as a result of a further detected positional change, said main alarm signal, for example, being able to be louder than the pre-alarm signal.

By actuating the locking mechanism 40 by means of the associated key 42 for the purpose of locking the securing hoop 12, the user can thus not only bring about a desired mechanical locking, but can also simultaneously and in a simple manner select whether the alarm device 60 should be activated or not. To selectively activate the alarm device 60, the locking mechanism 40 is moved by means of the associated key 42 into an alarm activation position that is provided in addition to an unlocked position and a locked position of the locking mechanism 40.

In this respect, the key 42 can be introduced into the cylinder core 44 and removed from the cylinder core 44 in three different positions of the cylinder core 44, namely in the first locked position (alarm device 60 deactivated), in the second locked position (alarm activation position), and in the unlocked position. Two different positions of the locking mechanism 40 can hereby be selected in which the associated key 42 can be removed from the lock cylinder with the alarm device 60 being deactivated in the one position and with the alarm device 60 being activated in the other position.

In the above-explained purely mechanical embodiment, the locking mechanism 40 comprises a lock cylinder that is rotatably actuable by an associated key 42 and that has a cylinder core 44 and a drive prolongation 46. With an electromechanical embodiment, the lock cylinder could, for example, be replaced with an electric motor that can in particular have a reducing gear and an associated control device and that can drive the drive prolongation 46 to make a rotational movement. This can take place, for example, on the basis of an encoded control signal that is transmitted by the authorized user by means of a radio remote control unit. The authorized user can also indirectly select or control an activation state of the alarm device via the locking mechanism by moving the locking mechanism into an alarm activation position in such an embodiment.

What is claimed is:

1. A lock having an alarm function for a two-wheeler, comprising a lock body and a securing hoop that is movable relative to the lock body between a securing position to secure the two-wheeler and an open position to release the two-wheeler, wherein the lock body has a locking mechanism to selectively lock the securing hoop at the lock body in the securing position, and wherein the lock body furthermore comprises an alarm device for outputting an alarm signal, wherein the locking mechanism can selectively be moved into an unlocked position, a locked position, or an alarm activation position, with the securing hoop being released for a movement into the open position in the unlocked position, with the securing hoop located in the securing position being locked at the lock body in the locked position, and with the alarm device being activated or being able to be activated by moving the locking mechanism into the alarm activation position, wherein the alarm activation position forms a further locked position, wherein the alarm device is deactivated in the locked position, and wherein in the further locked position the securing hoop located in the securing position is locked at the lock body and the alarm device is activated, wherein the locking mechanism has two latches, wherein the securing hoop has a first hoop end and a second hoop end, of which each has a first locking recess and a second locking recess, wherein in the locked position of the locking mechanism one of the two latches engages into the first locking recess of the first hoop end and the other one of the two latches engages into the first locking recess of the second hoop end, and wherein in the further locked position of the locking mechanism the one of the two latches engages into the second locking recess of the second hoop end and the other one of the two latches engages into the second locking recess of the first hoop end.

2. A lock in accordance with claim 1,
wherein the locking mechanism has a lock cylinder that is rotationally actuable by means of a key.

3. A lock in accordance with claim 2,
wherein the lock cylinder has a cylinder housing and a cylinder core rotatably supported in the cylinder housing, wherein the locked position of the locking mechanism corresponds to a first rotational position of the cylinder core, wherein the alarm activation position of the locking mechanism corresponds to a second rotational position of the cylinder core, and wherein the unlocked position of the locking mechanism corresponds to a third rotational position of the cylinder core.

4. A lock in accordance with claim 3,
wherein the key can be introduced into the cylinder core and removed from the cylinder core in the first rotational position of the cylinder core and in the second rotational position of the cylinder core.

5. A lock in accordance with claim 2,
wherein the two latches are drivable by means of the lock cylinder.

6. A lock in accordance with claim 5,
wherein the lock cylinder is coupled to the two latches via a deflection device that deflects a rotational movement of the lock cylinder into a linear movement of the two latches.

7. A lock in accordance with claim 1,
wherein the locking mechanism has an electric motor.

8. A lock in accordance with claim 1,
wherein the two latches are drivable in opposite senses to one another by an actuation of the locking mechanism in a first direction of rotation, and wherein the two latches are also drivable in opposite senses to one another by an actuation of the locking mechanism in a direction of rotation opposite to the first direction of rotation.

9. A lock in accordance with claim 1,
wherein the lock has a position detector that is configured to determine whether the locking mechanism is in the alarm activation position.

10. A lock in accordance with claim 1,
wherein the alarm device has at least one of the following components:
an electrical energy source for the energy supply of further components of the alarm device;

an acceleration sensor or a vibration sensor;
an evaluation and control circuit;
an acoustic and/or optical signal generator; and/or
a radio transmission unit for the wireless transmission of an alarm signal.

* * * * *